US009421473B2

(12) United States Patent
Ostendorff et al.

(10) Patent No.: US 9,421,473 B2
(45) Date of Patent: Aug. 23, 2016

(54) WALL MOUNTED TOY TRACK SET

(71) Applicant: Mattel, Inc., El Segundo, CA (US)

(72) Inventors: Eric C. Ostendorff, Torrance, CA (US); Sang Joon Kwak, La Habra, CA (US)

(73) Assignee: Mattel, Inc., El Segundo, CA (US)

( * ) Notice: Subject to any disclaimer, the term of this patent is extended or adjusted under 35 U.S.C. 154(b) by 106 days.

(21) Appl. No.: 14/045,911

(22) Filed: Oct. 4, 2013

(65) Prior Publication Data

US 2014/0097263 A1 Apr. 10, 2014

Related U.S. Application Data

(60) Provisional application No. 61/709,426, filed on Oct. 4, 2012.

(51) Int. Cl.

| | |
|---|---|
| ***A63H 18/02*** | (2006.01) |
| ***A63H 18/04*** | (2006.01) |
| ***A63H 18/08*** | (2006.01) |

(52) U.S. Cl.

CPC ..... *A63H 18/023* (2013.01); *A63H 18/04* (2013.01); *A63H 18/08* (2013.01); *A63H 18/025* (2013.01)

(58) Field of Classification Search

CPC ..... A63H 13/00; A63H 13/04; A63H 17/00; A63H 17/004; A63H 18/00; A63H 18/02; A63H 18/025; A63H 18/04; A63H 18/06

USPC ..... 238/10 R, 10 A, 10 B, 10 C, 10 F; 446/275, 429, 430, 435

See application file for complete search history.

(56) References Cited

U.S. PATENT DOCUMENTS

| | | | |
|---|---|---|---|
| 469,948 | A | 3/1892 | Reed |
| 806,930 | A | 12/1905 | Smith |
| 812,595 | A | 2/1906 | Roberts |
| 831,907 | A | 9/1906 | Townsend |
| 889,169 | A | 6/1908 | Brothen |
| 1,113,945 | A | 10/1914 | Bain |
| 1,116,577 | A | 11/1914 | Dugger |
| 1,209,127 | A | 12/1916 | Corey |

(Continued)

FOREIGN PATENT DOCUMENTS

| | | | |
|---|---|---|---|
| CN | 201067632 | Y | 6/2008 |
| CN | 101687116 | A | 3/2010 |

(Continued)

OTHER PUBLICATIONS

Partial European Search Report for Application No. 13187427.3-1658; Dated: Feb. 5, 2014.

(Continued)

*Primary Examiner* — R. J. McCarry, Jr.
(74) *Attorney, Agent, or Firm* — Kolisch Hartwell, P.C.

(57) ABSTRACT

A toy vehicle track set is provided including a first track portion and a second track portion. The second track portion is distal from the first track portion. The first track portion and the second track portion define a gap therebetween. The toy vehicle track set also includes a pair of separately rotating arms. The rotating arms cooperate to transfer a toy vehicle across the gap from the first track portion to the second track portion. When the toy vehicle is released at the second track portion, the toy vehicle may traverse along a path of the track set from the second track portion to the first track portion.

20 Claims, 6 Drawing Sheets

(56) References Cited

U.S. PATENT DOCUMENTS

| | | | |
|---|---|---|---|
| 1,244,457 | A | 10/1917 | Bain |
| 1,244,702 | A | 10/1917 | Christ |
| 1,247,226 | A | 11/1917 | Cole |
| 1,252,616 | A | 1/1918 | Reif |
| 1,261,691 | A | 4/1918 | Bunkley |
| 1,279,271 | A | 9/1918 | Cole |
| 1,284,477 | A | 11/1918 | Seils |
| 1,287,450 | A | 12/1918 | Sabina et al. |
| 1,287,608 | A | 12/1918 | Austin |
| 1,295,504 | A | 2/1919 | Howard et al. |
| 1,301,552 | A | 4/1919 | Gaines |
| 1,314,238 | A | 8/1919 | Bain |
| 1,315,108 | A | 9/1919 | Gaines |
| 1,317,184 | A | 9/1919 | Voss |
| RE14,902 | E | 6/1920 | Gaines |
| 1,347,968 | A | 7/1920 | O'Doie |
| 1,351,981 | A | 9/1920 | Zipf |
| 1,355,636 | A | 10/1920 | Bain |
| 1,361,449 | A | 12/1920 | Danner |
| 1,392,727 | A | 10/1921 | Welsh |
| 1,454,173 | A | 5/1923 | Keiner |
| 1,472,783 | A | 11/1923 | Bauer |
| 1,478,350 | A | 12/1923 | Okel |
| RE15,900 | E | 8/1924 | Hetzner |
| 1,523,244 | A | 1/1925 | Bain |
| 1,527,006 | A | 2/1925 | O'Reilly |
| 1,546,377 | A | 7/1925 | Gunderman |
| 1,560,181 | A | 11/1925 | Marx |
| 1,561,633 | A | 11/1925 | Bain |
| 1,568,492 | A | 1/1926 | Zabel |
| 1,599,699 | A | 9/1926 | Zabel |
| 1,599,982 | A | 9/1926 | Bauer |
| 1,617,846 | A | 2/1927 | Hawk |
| RE16,791 | E | 11/1927 | Hawk |
| 1,666,417 | A | 4/1928 | Harris |
| 1,696,532 | A | 12/1928 | Enloe |
| RE17,312 | E | 6/1929 | Beck |
| 1,715,891 | A | 6/1929 | Beck |
| 1,724,447 | A | 8/1929 | Abbott et al. |
| 1,725,536 | A | 8/1929 | Marx |
| 1,739,719 | A | 12/1929 | Gunderman |
| 1,748,184 | A | 2/1930 | Nichols |
| 1,758,061 | A | 5/1930 | Rentz et al. |
| 1,870,586 | A | 8/1932 | Platakis |
| 1,872,204 | A | 8/1932 | Wily |
| 2,128,863 | A | 8/1938 | Turrian |
| 2,211,220 | A | 8/1940 | Verplanck |
| 2,249,728 | A | 7/1941 | Cross |
| 2,336,773 | A | 12/1943 | Black et al. |
| 2,391,529 | A | 12/1945 | Walker |
| 2,392,722 | A | 1/1946 | Burlin |
| 2,400,013 | A | 5/1946 | Lowell et al. |
| 2,400,410 | A | 5/1946 | Hatcher |
| 2,419,990 | A | 5/1947 | Dishmaker |
| 2,434,571 | A | 1/1948 | Long |
| 2,531,564 | A | 11/1950 | Garbe |
| 2,616,699 | A | 11/1952 | Franks |
| 2,634,128 | A | 4/1953 | Reed |
| 2,655,116 | A | 10/1953 | Gowland |
| 2,672,709 | A | 3/1954 | Ernst |
| 2,756,687 | A | 7/1956 | Fields |
| 2,785,504 | A | 3/1957 | Kooistra, Sr. |
| 2,838,159 | A | 6/1958 | Siegfried |
| 2,853,301 | A | 9/1958 | Glass |
| 2,998,673 | A | 9/1961 | Rhodes |
| 2,999,689 | A | 9/1961 | Litwinczuk |
| 3,251,155 | A | 5/1966 | Bjork |
| 3,298,692 | A | 1/1967 | Glass et al. |
| 3,300,891 | A | 1/1967 | Glass et al. |
| 3,314,169 | A | 4/1967 | Wold |
| 3,343,793 | A | 9/1967 | Waser |
| 3,401,484 | A | 9/1968 | Anslover |
| 3,542,366 | A | 11/1970 | Schocker |
| 3,548,534 | A | 12/1970 | Beny et al. |
| 3,570,171 | A | 3/1971 | Shook |
| 3,572,713 | A | 3/1971 | Krause |
| 3,600,849 | A | 8/1971 | Faller |
| 3,621,602 | A | 11/1971 | Barcus et al. |
| 3,633,308 | A | 1/1972 | Yang |
| 3,666,264 | A | 5/1972 | Bartlett |
| 3,703,989 | A | 11/1972 | Tomiyama |
| 3,708,116 | A | 1/1973 | Woodward |
| 3,712,538 | A | 1/1973 | Starr et al. |
| 3,726,476 | A | 4/1973 | Porter et al. |
| 3,734,404 | A | 5/1973 | Baynes et al. |
| 3,735,923 | A | 5/1973 | Brigham et al. |
| 3,795,983 | A | 3/1974 | Gallagher et al. |
| 3,803,756 | A | 4/1974 | Strongin |
| 3,818,628 | A | 6/1974 | Ensmann et al. |
| 3,860,238 | A | 1/1975 | Kojima |
| 3,908,303 | A | 9/1975 | McKay et al. |
| 3,986,296 | A | 10/1976 | Hamano |
| 4,037,355 | A | 7/1977 | Street |
| 4,055,913 | A | 11/1977 | Sindelar |
| 4,068,402 | A | 1/1978 | Tanaka |
| 4,091,561 | A | 5/1978 | Kimura |
| 4,094,089 | A | 6/1978 | Sano |
| 4,128,964 | A | 12/1978 | Ogasawara |
| 4,140,276 | A | 2/1979 | Halford |
| 4,146,991 | A | 4/1979 | Sano |
| 4,159,593 | A | 7/1979 | Miller |
| 4,161,279 | A | 7/1979 | Halford |
| 4,185,409 | A | 1/1980 | Cheng |
| 4,195,776 | A | 4/1980 | Lehmann |
| 4,203,247 | A | 5/1980 | Moe et al. |
| 4,219,198 | A | 8/1980 | Meyer et al. |
| 4,223,834 | A | 9/1980 | Fechter |
| 4,241,534 | A | 12/1980 | Larsson et al. |
| 4,249,733 | A | 2/1981 | Eddins et al. |
| 4,254,576 | A | 3/1981 | Matsumoto et al. |
| 4,267,661 | A | 5/1981 | Hanson |
| 4,291,488 | A | 9/1981 | Orenstein |
| 4,301,613 | A | 11/1981 | Kooistra, Sr. |
| 4,312,149 | A | 1/1982 | Iwao |
| 4,357,778 | A | 11/1982 | Matsumoto et al. |
| 4,373,693 | A | 2/1983 | Greenberger |
| 4,386,777 | A | 6/1983 | Prehodka |
| 4,394,961 | A | 7/1983 | Muller |
| 4,426,797 | A | 1/1984 | Burkemper et al. |
| 4,468,031 | A | 8/1984 | Barlow et al. |
| 4,475,303 | A | 10/1984 | Ribas et al. |
| 4,496,100 | A | 1/1985 | Schwager et al. |
| 4,513,966 | A | 4/1985 | Mucaro et al. |
| 4,519,789 | A | 5/1985 | Halford et al. |
| 4,557,064 | A | 12/1985 | Thompson |
| 4,558,867 | A | 12/1985 | Hippely |
| 4,564,197 | A | 1/1986 | Lambert et al. |
| 4,575,350 | A | 3/1986 | Hippely et al. |
| RE32,106 | E | 4/1986 | Lemelson |
| 4,585,166 | A | 4/1986 | Stephens |
| 4,609,363 | A | 9/1986 | Udagawa |
| 4,659,320 | A | 4/1987 | Rich et al. |
| 4,673,308 | A | 6/1987 | Reilly |
| 4,678,449 | A | 7/1987 | Udagawa |
| 4,708,685 | A | 11/1987 | Udagawa |
| 4,715,843 | A | 12/1987 | Ostendorff et al. |
| 4,734,076 | A | 3/1988 | Goldstein et al. |
| 4,795,394 | A | 1/1989 | Thompson |
| 4,874,342 | A | 10/1989 | Klitsner |
| 4,909,464 | A | 3/1990 | Levine et al. |
| 4,928,955 | A | 5/1990 | Chuan |
| 4,932,917 | A | 6/1990 | Klitsner |
| 4,951,872 | A | 8/1990 | Sheffield |
| 4,961,716 | A * | 10/1990 | Hippely et al. ..... 446/75 |
| 5,022,884 | A | 6/1991 | Hippely et al. |
| 5,075,515 | A | 12/1991 | Yoneda et al. |
| 5,078,642 | A | 1/1992 | Glessner |
| 5,102,133 | A | 4/1992 | Chilton et al. |
| 5,107,601 | A | 4/1992 | Semchuck |
| 5,161,104 | A | 11/1992 | Fox et al. |
| 5,174,569 | A | 12/1992 | Ngai |
| 5,254,030 | A | 10/1993 | Ostendorff et al. |
| 5,299,969 | A | 4/1994 | Zaruba |
| 5,312,285 | A | 5/1994 | Rieber et al. |

(56) References Cited

U.S. PATENT DOCUMENTS

| | | | |
|---|---|---|---|
| 5,342,048 | A | 8/1994 | Jones et al. |
| 5,344,143 | A | 9/1994 | Yule |
| 5,370,571 | A | 12/1994 | Bosch |
| 5,392,987 | A | 2/1995 | Ropers et al. |
| 5,419,066 | A | 5/1995 | Harnois et al. |
| 5,473,833 | A | 12/1995 | Ostrovsky |
| 5,480,115 | A | 1/1996 | Haltof |
| 5,542,668 | A | 8/1996 | Casale et al. |
| 5,586,923 | A | 12/1996 | Hippely et al. |
| 5,735,724 | A | 4/1998 | Udagawa |
| 5,767,655 | A | 6/1998 | Ostendorff et al. |
| 5,785,573 | A | 7/1998 | Rothbarth et al. |
| 5,803,782 | A | 9/1998 | Selton |
| 5,846,018 | A | 12/1998 | Frobosilo et al. |
| 5,855,501 | A | 1/1999 | Kato et al. |
| 5,899,011 | A | 5/1999 | Brinkman |
| 5,899,789 | A | 5/1999 | Rehkemper et al. |
| 5,967,052 | A | 10/1999 | Prokopf |
| 6,000,992 | A | 12/1999 | Lambert |
| 6,026,603 | A | 2/2000 | Kump et al. |
| 6,056,620 | A | 5/2000 | Tobin |
| 6,170,754 | B1 | 1/2001 | Halford |
| 6,241,573 | B1 | 6/2001 | Ostendorff et al. |
| 6,358,112 | B1 | 3/2002 | Lambert et al. |
| 6,409,132 | B2 | 6/2002 | Heisler et al. |
| 6,439,955 | B1 | 8/2002 | Feketo |
| 6,478,654 | B1 | 11/2002 | Rehkemper et al. |
| 6,508,179 | B2 | 1/2003 | Annis et al. |
| 6,640,453 | B2 | 11/2003 | Eisenmenger |
| 6,647,893 | B1 | 11/2003 | Fugitt et al. |
| 6,676,480 | B2 | 1/2004 | Sheltman |
| 6,766,585 | B2 | 7/2004 | Thomas |
| 6,783,419 | B1 | 8/2004 | Paukert et al. |
| 6,862,997 | B2 | 3/2005 | Bussink |
| 6,951,307 | B2 | 10/2005 | Lin |
| 6,951,497 | B1 | 10/2005 | Ngan |
| 6,951,498 | B2 | 10/2005 | Rudell |
| 6,953,377 | B2 | 10/2005 | Quercetti |
| D511,961 | S | 11/2005 | Jordan |
| 6,976,316 | B1 | 12/2005 | Patterson |
| 7,066,783 | B2 | 6/2006 | Fischer |
| 7,325,348 | B2 | 2/2008 | Mueller et al. |
| 7,353,758 | B2 | 4/2008 | Murray |
| 7,373,731 | B2 | 5/2008 | Nyberg |
| 7,517,272 | B2 | 4/2009 | Bedford et al. |
| 7,527,156 | B2 | 5/2009 | Wisnoski et al. |
| 7,549,906 | B2 | 6/2009 | Bedford et al. |
| 7,600,757 | B1 | 10/2009 | Matilla et al. |
| 7,600,859 | B2 | 10/2009 | Huang et al. |
| 7,614,931 | B2 | 11/2009 | Nuttall |
| 7,618,302 | B2 | 11/2009 | Collins et al. |
| 7,628,673 | B2 | 12/2009 | Bedford et al. |
| 7,651,398 | B2 | 1/2010 | Ostendorff et al. |
| 7,690,964 | B2 | 4/2010 | Nuttall et al. |
| 7,708,317 | B2 | 5/2010 | Leblanc |
| 7,766,720 | B2 | 8/2010 | Ostendorff |
| 7,770,811 | B2 | 8/2010 | Belding |
| 7,857,679 | B2 | 12/2010 | O'Connor et al. |
| 8,162,716 | B2 | 4/2012 | Nuttall |
| 8,430,712 | B2 | 4/2013 | O'Connor et al. |
| 8,608,527 | B2 | 12/2013 | O'Connor et al. |
| 8,690,462 | B2 | 4/2014 | Shaw et al. |
| 8,690,632 | B2 | 4/2014 | O'Connor et al. |
| 8,747,180 | B2 | 6/2014 | O'Connor et al. |
| 8,814,628 | B2 | 8/2014 | O'Connor et al. |
| 2003/0220044 | A1 | 11/2003 | Andrews et al. |
| 2003/0224697 | A1 | 12/2003 | Sheltman et al. |
| 2004/0078991 | A1 | 4/2004 | Thomas |
| 2005/0287915 | A1 | 12/2005 | Sheltman et al. |
| 2005/0287919 | A1 | 12/2005 | Sheltman et al. |
| 2006/0027779 | A1 | 2/2006 | McGuire |
| 2006/0277779 | A1 | 12/2006 | Bauer |
| 2006/0286896 | A1 | 12/2006 | Bedford et al. |
| 2006/0286897 | A1 | 12/2006 | Bedford et al. |
| 2007/0012636 | A1 | 1/2007 | Wisnoski et al. |
| 2007/0049160 | A1 | 3/2007 | Matthes et al. |
| 2007/0128969 | A1 | 6/2007 | Shrock et al. |
| 2007/0209543 | A1 | 9/2007 | Beaulieu et al. |
| 2008/0064295 | A1 | 3/2008 | Abrams |
| 2008/0066560 | A1 | 3/2008 | Yu et al. |
| 2008/0070474 | A1 | 3/2008 | Nuttall |
| 2008/0268743 | A1 | 10/2008 | O'Connor et al. |
| 2009/0075558 | A1 | 3/2009 | Ostendorff |
| 2010/0056015 | A1 | 3/2010 | Nuttall |
| 2010/0112896 | A1 | 5/2010 | Chang et al. |
| 2010/0184353 | A1 | 7/2010 | Jobe |
| 2010/0199598 | A1 | 8/2010 | Townsend et al. |
| 2010/0273394 | A1 | 10/2010 | O'Connor et al. |
| 2011/0086574 | A1 | 4/2011 | Nuttall et al. |
| 2011/0124265 | A1 | 5/2011 | O'Connor et al. |
| 2011/0269372 | A1 | 11/2011 | Nuttall |
| 2012/0052766 | A1 | 3/2012 | Payne |
| 2012/0052767 | A1 | 3/2012 | Martino et al. |
| 2012/0061484 | A1 | 3/2012 | Payne et al. |
| 2012/0062766 | A1 | 3/2012 | Park |
| 2012/0115393 | A1 | 5/2012 | Moh et al. |
| 2012/0164914 | A1* | 6/2012 | O'Connor et al. ..... 446/444 |
| 2012/0276808 | A1 | 11/2012 | Nuttall et al. |
| 2012/0322342 | A1* | 12/2012 | De La Torre ..... 446/444 |
| 2013/0288568 | A1 | 10/2013 | Schmid et al. |
| 2014/0070015 | A1 | 3/2014 | Matthes et al. |

FOREIGN PATENT DOCUMENTS

| | | | |
|---|---|---|---|
| GB | 2043469 | A | 10/1980 |
| JP | 07-328241 | A | 12/1995 |
| WO | 88-04191 | A1 | 6/1988 |
| WO | 2011137433 | A2 | 3/2011 |
| WO | 2012027737 | A2 | 1/2012 |
| WO | 2012027737 | A3 | 3/2012 |
| WO | 2012027753 | A2 | 3/2012 |
| WO | 2012027753 | A3 | 3/2012 |

OTHER PUBLICATIONS

European Search Report dated Nov. 13, 2013 for Application No. 13168331.0.

European Search Report dated Nov. 5, 2013 for Application No. 13184129.8.

International Search Report dated Apr. 9, 2012 for International Application No. PCT/US2011/049587.

Written Opinion dated Apr. 9, 2012 for International Application No. PCT/US2011/049587.

English Abstract JP7328241.

English Translation of Abstract CN201067632.

English Translation of Abstract CN101687116.

English Translation of Chinese Office Action for Application No. 2013101901814 dated Feb. 3, 2015.

Chinese Office Action for Application No. 2013101901814 dated Feb. 3, 2015.

* cited by examiner

WALL MOUNTED TOY TRACK SET

CROSS REFERENCE TO RELATED APPLICATIONS

This application claims the benefit of U.S. Provisional Patent Application No. 61/709,426, filed Oct. 4, 2012, the contents of which are incorporated herein by reference thereto.

BACKGROUND

Various embodiments of the present invention are related to toys. In particular, various embodiments of the present invention are related to a track set for toy vehicles.

Toy vehicle track sets have been popular for many years and generally include one or more track sections arranged to form a path around which one or more toy vehicles can travel. Some toy vehicles that may be used on such track sets are self-powered vehicles, and some receive power from an external source.

Accordingly, it is desirable to provide toy track set with features that provide unique paths for the toy vehicles of the toy track to travel on.

BRIEF SUMMARY OF INVENTION

In one embodiment a toy vehicle track set is provided including a first track portion and a second track portion. The second track portion is distal from the first track portion. The first track portion and the second track portion define a gap therebetween. The toy vehicle track set also includes a pair of separately rotating arms. The rotating arms cooperate to transfer a toy vehicle across the gap from the first track portion to the second track portion. When the toy vehicle is released at the second track portion, the toy vehicle may traverse along a path of the track set from the second track portion to the first track portion.

In another embodiment, a toy vehicle track set is provided. The toy vehicle track set having: a first track portion; a second track portion elevated vertically from the first track portion; a pair of arm members rotatably mounted to a support, wherein each arm member has a claw member configured to releasably receive and retain a toy vehicle therein, wherein the pair of arm members and each claw member associated therewith are configured to transfer a toy vehicle therebetween as the pair of arm members each rotate about an axis.

In yet another embodiment, a toy vehicle track set is provided. The toy vehicle track set having: a lower track portion; a first toy vehicle feed mechanism configured to release a toy vehicle from the lower track portion upon actuation of an actuator of the first toy vehicle feed mechanism; an upper track portion having an upper end and a first lower end; a second toy vehicle feed mechanism configured to release a toy vehicle from the upper track portion upon actuation of an actuator of the second toy vehicle feed mechanism; a first arm member rotatably secured to the toy vehicle track set, the first arm member having a claw member configured to move from an open position to a closed position in order to receive the toy vehicle from the first toy vehicle feed mechanism; a second arm member rotatably secured to the toy vehicle track set, the second arm member having a claw member configured to move from an open position to a closed position in order to receive the toy vehicle from the claw member of the first arm member, wherein the second arm member transfers the toy vehicle to the upper end of the upper track portion after it has received the toy vehicle from the claw member of the first arm member; and wherein the actuator of the first toy vehicle feed mechanism is actuated through rotational movement of the first arm member.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
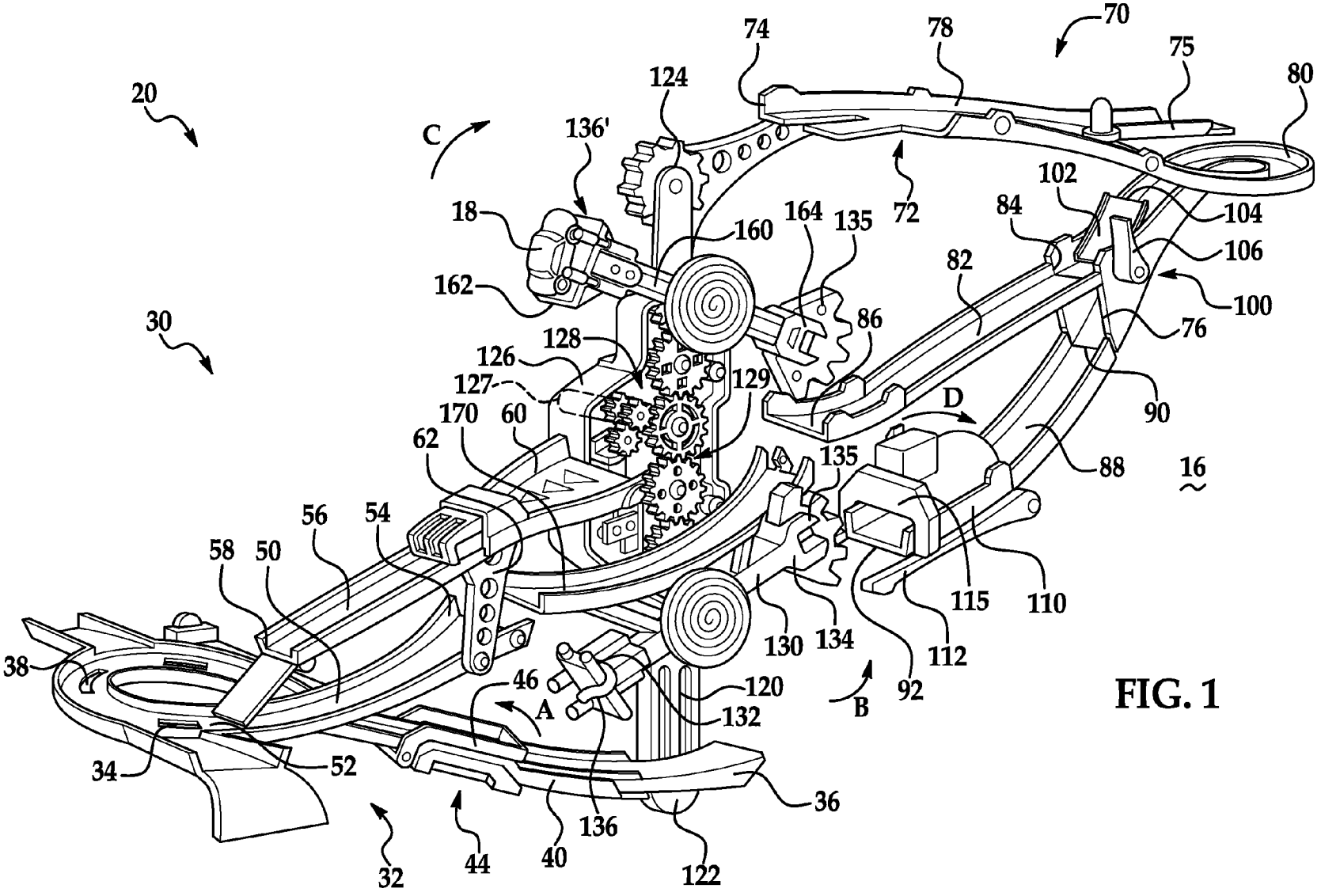
FIG. 1 is a perspective view of a toy vehicle track set according to an embodiment of the invention.

Referring now to the FIGS., a track set 20 in accordance with various embodiments of the present invention is illustrated. In some embodiments, the track set 20 is mounted to a wall 16 via one or more wall mounts 10. Each wall mount 10 has a planar member 14 that is secured to a wall 16 via removable double-sided adhesive tape or other equivalent material. One non-limiting example of such adhesive tape it is commercially available from 3M and sold under the trademark COMMAND STRIP. In some embodiments, the wall mount 10 may be that described in commonly owned U.S. patent Ser. No. 13/220,364, filed on Aug. 29, 2011, and U.S. Provisional Patent Application Ser. Nos. 61/377,743, filed on Aug. 27, 2010, and 61/480,793, filed on Apr. 29, 2011, the contents each of which are incorporated herein by reference thereto in their entirety. It should be appreciated that while embodiments of this invention illustrate the track set 20 mounted to a wall 16, the claimed invention should not be so limited, in other embodiments the track set 20 may include support stands that allow the track set 20 to be a free standing track set that rests on a play surface, which may be a horizontal play surface. In yet other embodiments, portions of the track set 20 may be mounted to a wall 16 while other portions of the track set 20 may include support stands for resting on a playing surface (e.g., horizontal or otherwise).

The track set 20 includes multiple track portions, for example a lower track portion 30 and an upper track portion 70. The track portions 30, 70 provide at least one path of travel for a toy, such as a toy vehicle 18 for example. The lower track portion 30 and the upper track portion 70 are disconnected from one another and may be separated by both a vertical distance and a horizontal distance. In some embodiments, each track portion 30, 70 is oriented such that a gravitational force causes the toy vehicle 18 to move along the path of travel of the track set 20.

The lower track portion 30 includes a first track segment 32 having a generally curved section 38 adjacent a first end 34 and a generally straight section 40 extending from the curved section 38 to a second end 36. In some embodiments, a start platform 42 is connected to a portion of the first track segment 32, such that the start platform 42 provides an entrance for the toy vehicle 18 into the path of travel of the track set 20.

A toy vehicle feed system 44 is connected to the first track segment 32 for releasably retaining a toy vehicle 18. In some embodiments, the toy vehicle feed system 44 is connected to the straight section 40 adjacent the second end 36. Alternatively, the toy vehicle feed system 44 may be mounted to the curved section 38 of the first track segment 32. The toy vehicle feed system 44 includes a gate 46 pivotally coupled to the first track segment 32 for movement between a blocking position (e.g., where toy vehicles 18 are retained by gate 46) and a release position (e.g., where toy vehicles 18 can travel underneath gate 46) such that the gate 46 is configured to rotate out of the path of travel along the track set 20, in the direction indicated by arrow A as it moves from the blocking position to the release position. The gate 46 includes an activation device or component 48, such as a lever for example, such that when the activation device 48 is actuated or moved, the gate 46 moves from the blocking position to the release position. In the illustrated embodiment, the gate 46 may rotate away from the start platform 22. Application of a force to the activation device 48 causes the activation device 48, and therefore the gate 46 coupled thereto by any suitable means such as a linkage or direct physical connection, to rotate relative to the first track segment 32. When the gate 46 pivots out of the path of travel of the track set 20, the feed system 44 releases a toy vehicle 18, which then moves to the second end 36 of the first track segment 32 as a result of gravity. In some embodiments, when the applied force is removed from the activation device 48, gravity causes the gate 46 to rotate back to a position that blocks that path of travel along the track set 20. In other embodiments, a biasing force, such as from a spring, may move the gate 46 back to the blocking position.

Figure 2:
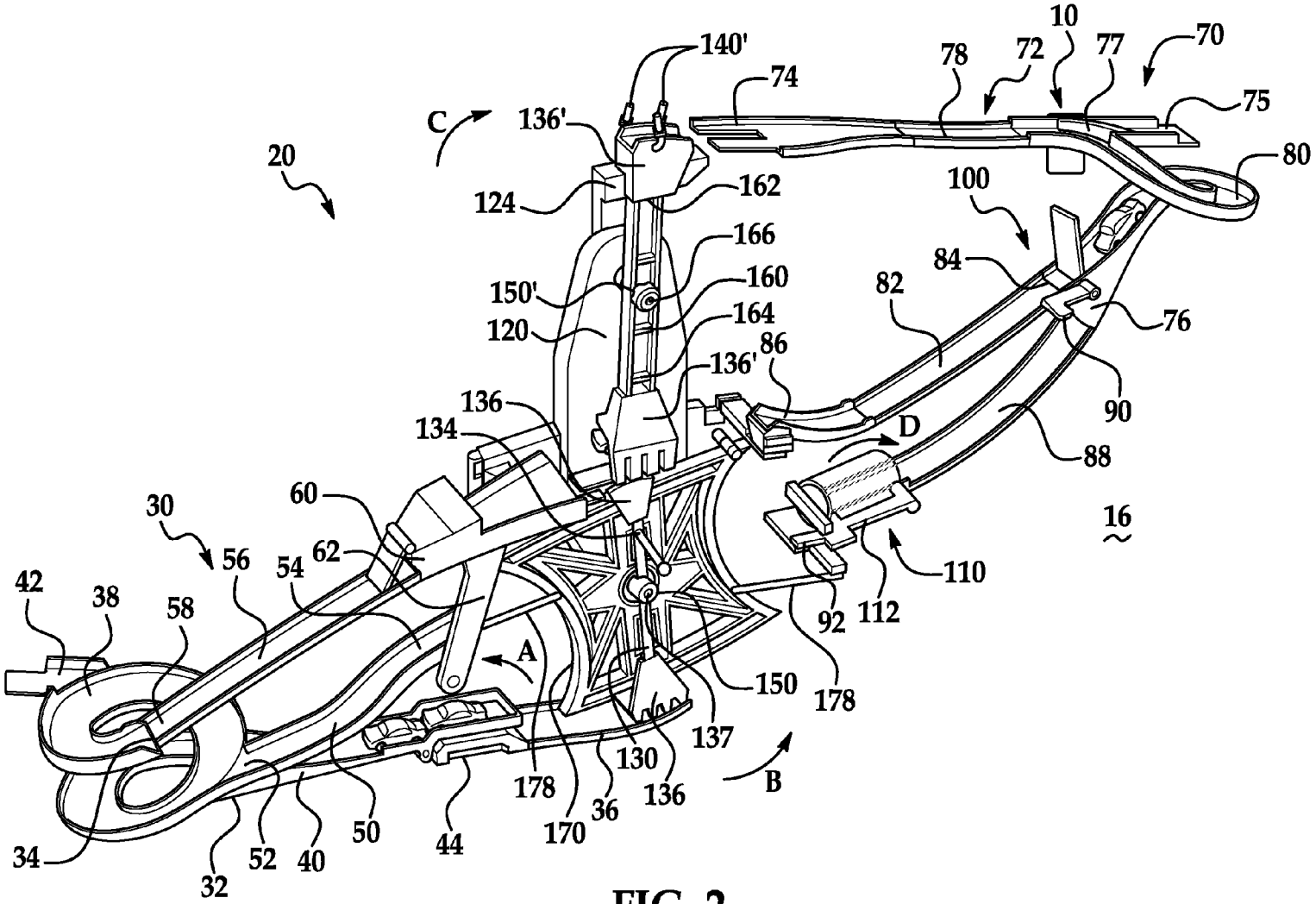
FIG. 2 is a perspective view of a toy vehicle track set according to an embodiment of the invention.

The lower track portion 30 of the track set 20 also includes a second track segment 50 connected to the first track segment 32. In the embodiment illustrated in FIG. 1, a first end 52 of the second track segment 50 connects to the first end 34 of the first track segment 32. In some embodiments, the second track segment 50 may be formed integrally with the first track segment 32. In other embodiments, the first end 52 of the second track segment 50 may connect to a central portion of the first track segment 32 (see FIG. 2), such as the curved section 38 for example.

A first end 58 of a third track segment 56 is positioned adjacent the curved section 38 of the first track segment 32. In some embodiments, the first end 58 of the third track segment 56 is connected to the first end 34 of the first track segment 32 (see FIG. 2). In other embodiments, the first end 58 of the third track segment 56 is spaced a distance above a portion of the first track segment 32 such that a toy vehicle 18 may travel along the first track segment 32 and underneath the third track segment 56 without interference (see FIG. 1). A second end 60 of the third track segment 56 may be flared compared to the remainder of the third track segment 56. A connector 62 supports the second end 54 of the second track segment 50 and the second end 60 of the third track segment 56. The connector 62 may extend to the first track segment 32 as well. In some embodiments, the connector 62 retains the third track segment 56 and the second track segment 50 in a generally parallel and vertically aligned position separated by a distance to prevent interference with the path of travel of a toy vehicle 18.

The upper track portion 70 includes a fourth track segment 72 having a generally straight section 78 adjacent a first end 74 and a generally curved section 80 adjacent a second end 76. In some embodiments, the straight section 78 includes an unconnected end 75 configured to couple the track set 20 to other track set(s) (not shown). A guide or diverter 77 pivotable between a first position and a second position is mounted between the unconnected end 75 and the curved section 80 of the fourth track segment. When the guide is in a first position (see FIG. 4), toy vehicles 18 travel from the straight section 78 to the curved section 80. When the guide 77 is rotated to the second position, the guide 77 blocks the path to the curved portion 80, such that toy vehicle 18 travels to the unconnected end 75 and to a coupled track set.

Figure 4:
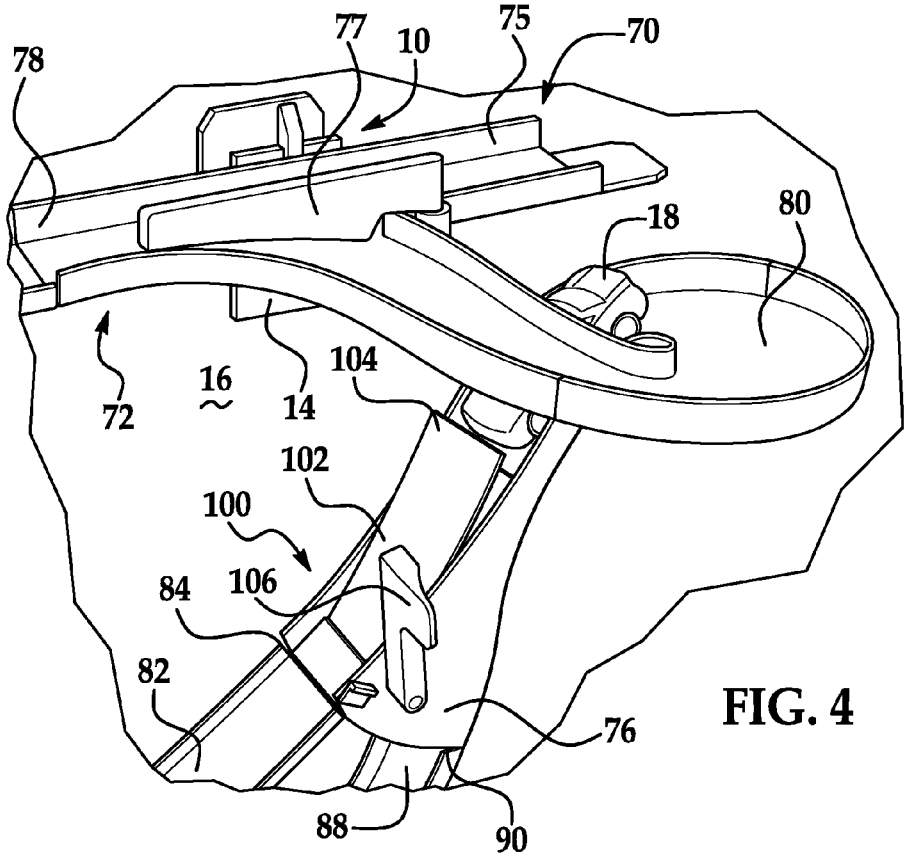
FIG. 4 is a perspective view of a switch of a toy vehicle track set according to an embodiment of the invention.

Both a first end 84 of a vertically aligned fifth track segment 82 and a first end 90 of a vertically aligned sixth track segment 88 are coupled to the second end 76 of the fourth track segment 72. A gate 100 for selectively controlling the path of travel of a toy vehicle 18 is positioned adjacent the second end 76 of the fourth track segment 72. The gate 100, as shown in FIG. 4, includes a generally flat piece of track 102 coupled to a lever 106. The lever 106 and the piece of track 102 are pivotable about a pin between an open position and a closed position. When the gate 100 is in a closed position, a free end 104 of the piece of track 102 is in contact or flush with the curved section 80 of the fourth track segment 72, such that a toy vehicle 18 travels to the connected fifth track segment 82. In some embodiments, the second end 86 of the fifth track segment 82 is curved in a direction away from the sixth track segment 88. When the gate 100 is in an open position, the free end 104 of the piece of track 102 is rotated away from the curved section 80 of the fourth track segment 72, thereby allowing a toy vehicle 18 to travel to the connected sixth track segment 88. A toy vehicle feed system 110, similar to the toy vehicle feed system 44 may be mounted adjacent the second end 92 of the sixth track segment 88. A portion of the toy vehicle feed system 110 is configured to rotate in the direction indicated by arrow D to selectively release a toy vehicle 18. In some embodiments, the activation device 112 of the toy vehicle feed system 110 is a lever extending beyond the second end 93 of the sixth track segment 88.

A generally vertical support 120 extends between the lower track portion 30 and the upper track portion 70 of the track set 20. In some embodiments, the second end 36 of the first track segment 32 is mounted to a first end 122 of the support 120 and the first end 74 of the fourth track segment 72 is mounted to the second end 124 of the support 120.

A first arm 130 is rotatably or movably mounted to the support 120 with a first shaft 137 and a second, similar arm 160 is rotatably or movably mounted to the support 120 with a second shaft 166. When the first arm 130 and the second arm 160 are arranged substantially vertically, a first end 132 of the first arm 130 can be positioned adjacent the second end 36 of the first track segment 32 and a first end 162 of the second arm 160 can be located adjacent the first end 74 of the fourth track segment 72. It is also understood the first and the second arm 130, 160 can also be arranged vertically or in any other position angular or otherwise without the first end 132 of the first arm 130 being adjacent the second end 36 of the first track segment 32 and the first end 162 of the second arm 160 being located adjacent the first end 74 of the fourth track segment 72 as the first arm 130 rotates about the first shaft 137 and the second arm 160 rotates about the second shaft 166.

The first arm 130 and the second arm 160 are configured to rotate about the first shaft 137 and the second shaft 166 respectively. In some embodiments, the first arm 130 is configured to rotate relative to the support 120 in the direction indicated by arrow B, and the second arm 160 is configured to rotate in an opposite direction, indicated by arrow C. In some embodiments, the support 120 includes a casing 126 that encloses a drive mechanism 128, such as a motor 127 coupled to a gear train 129, for rotating the first arm 130 and the second arm 160 simultaneously. In other words, a motor when activated applies a rotational force to a first one of a plurality of gears of the gear train 129 such that at least one of the gears of the gear train 129 causes the first arm 130 and the second arm 160 to rotated by the motor and in opposite directions. The gear train 129 may also keep the first arm 130 and the second arm 160 rotating in a fixed coordination with each other. In embodiments where the support 120 houses a drive mechanism 128, the support 120 acts as a central, motorized spine of the track set 20.

The pair of separately rotatable arms 130, 160 are configured to move a toy vehicle 18 from a first position on the lower track portion 30 to a second position on the upper track portion 70. In some embodiments, the pair of arms move a toy vehicle 18 from a first position at the second end 36 of the first track segment 32 to a second position at the first end 74 of the fourth track segment 72. Connected to a first end 132, 162 of both the first arm 130 and the second arm 160 is a claw member 136, 136' configured to releasably connect with a toy vehicle 18. In some embodiments, a claw member 136 is also connected to the second end 134, 164 of at least one of the first arm 130 and the second arm 160. Alternatively, a hazard 135, such as a gear portion, may be connected to the second end 134, 164 of the either first arm 130 and/or the second arm 160 (see FIG. 1). The hazard 135 may be configured to feign interference with the toy vehicle 18 as it travels from the upper portion track 70 to the lower track portion 30 of the track set 20. The first arm 130 and the second arm 160 are mounted to the support 120 such that the claw member 136 mounted to the first end 132 of the first arm 130 is in substantially meshing engagement with the claw member 136' mounted to the first end 162 of the second arm 160 when the first arm 130 and the second arm 160 are vertically aligned and the first ends 132, 162 are adjacent one another.

Figure 3:
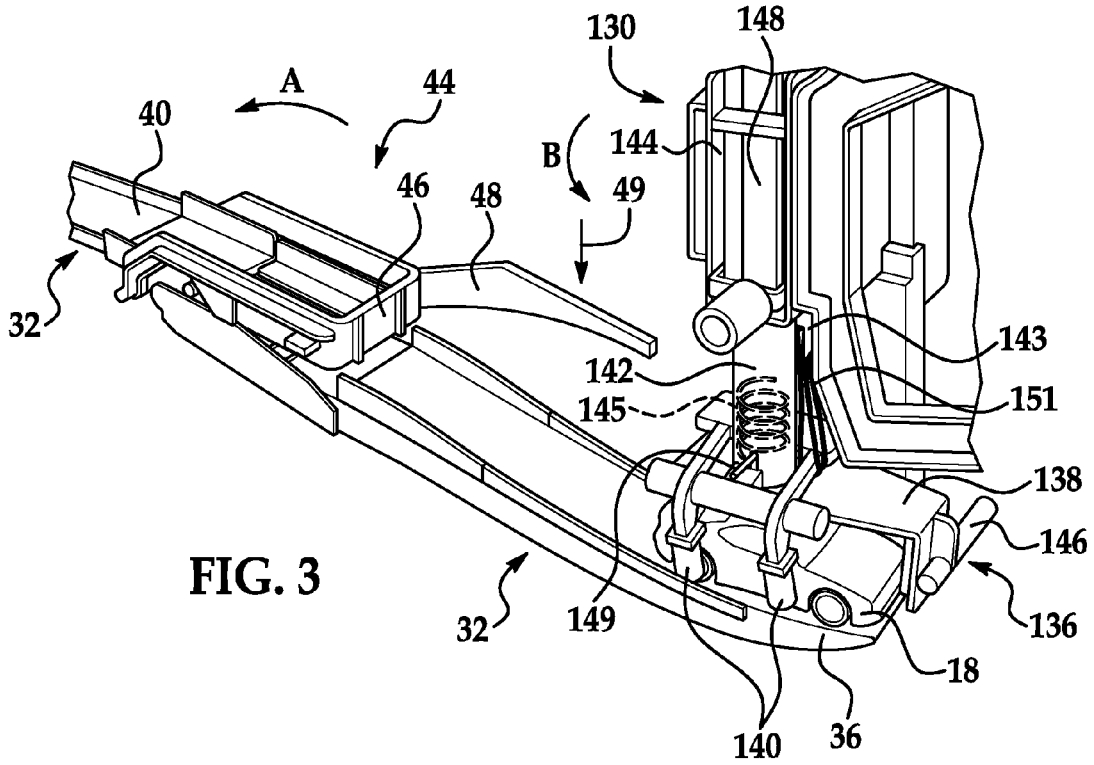
FIG. 3 is a perspective view of a toy vehicle feed system according to an embodiment of the invention.
Figure 5:
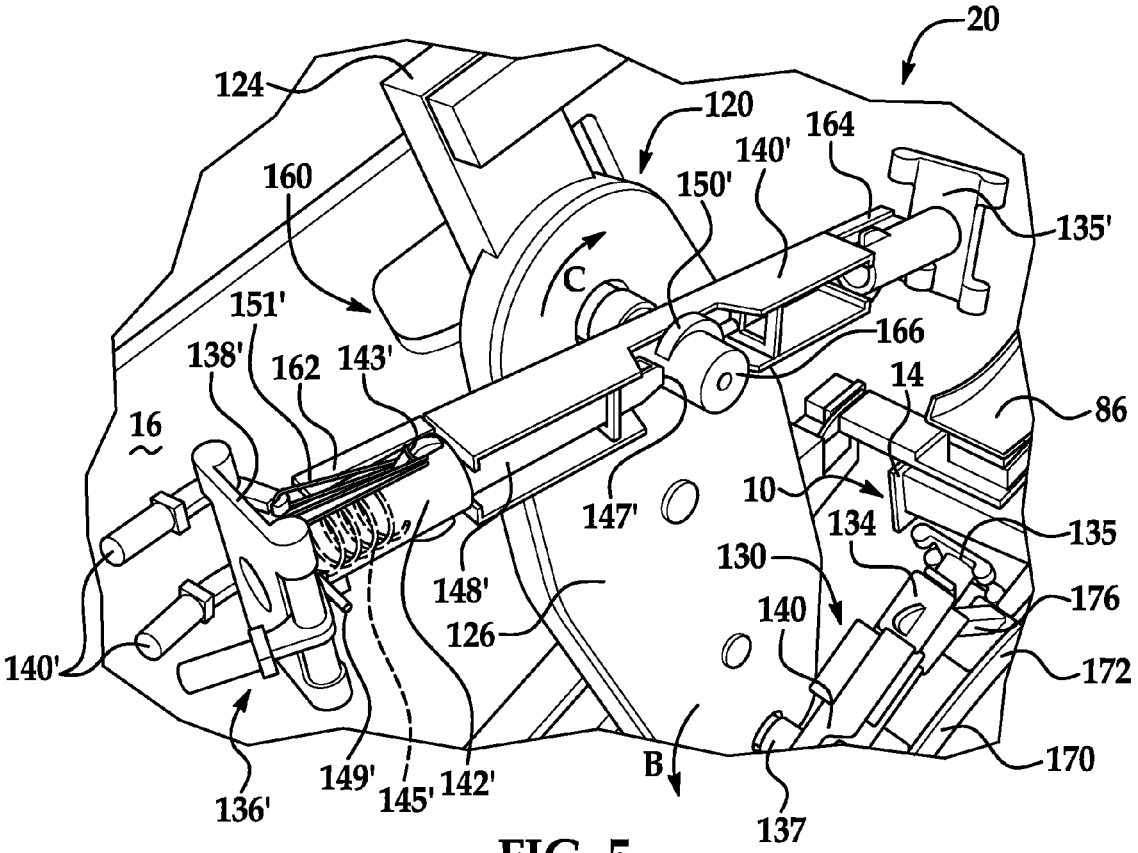
FIG. 5 is a perspective view of a second arm of a toy vehicle track set according to an embodiment of the invention.
Figure 6:
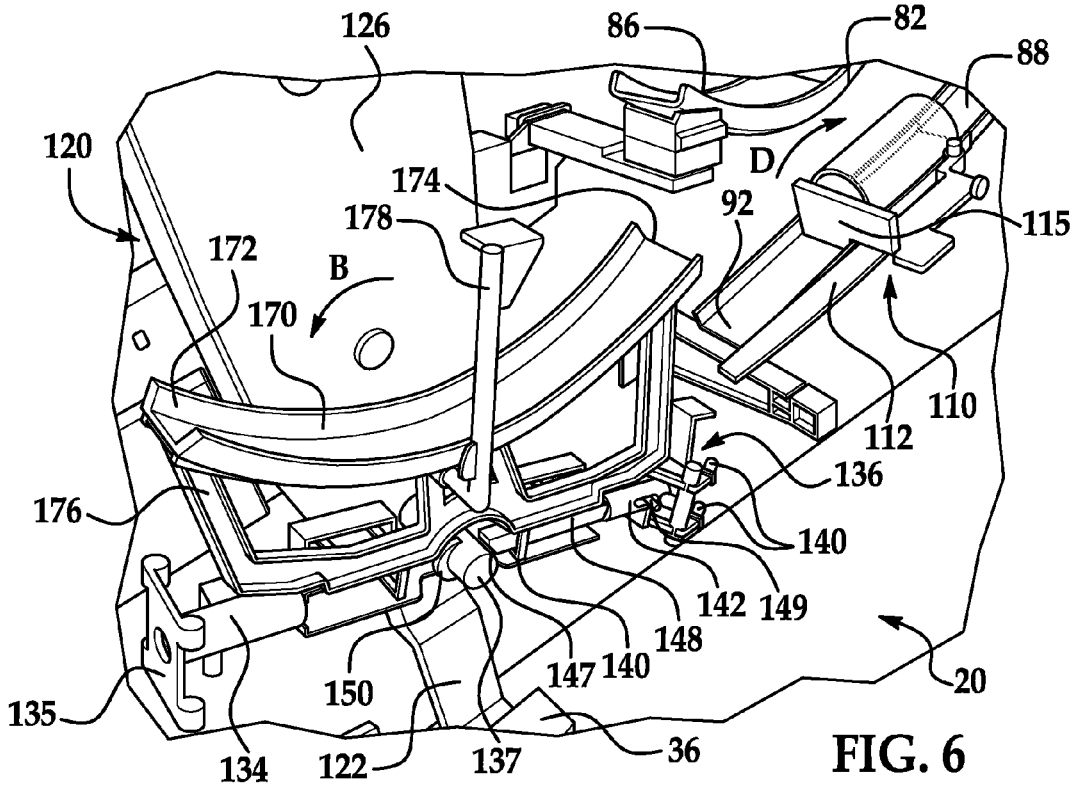
FIG. 6 is a perspective view of a first arm of a toy vehicle track set according to an embodiment of the invention.
Figure 7:
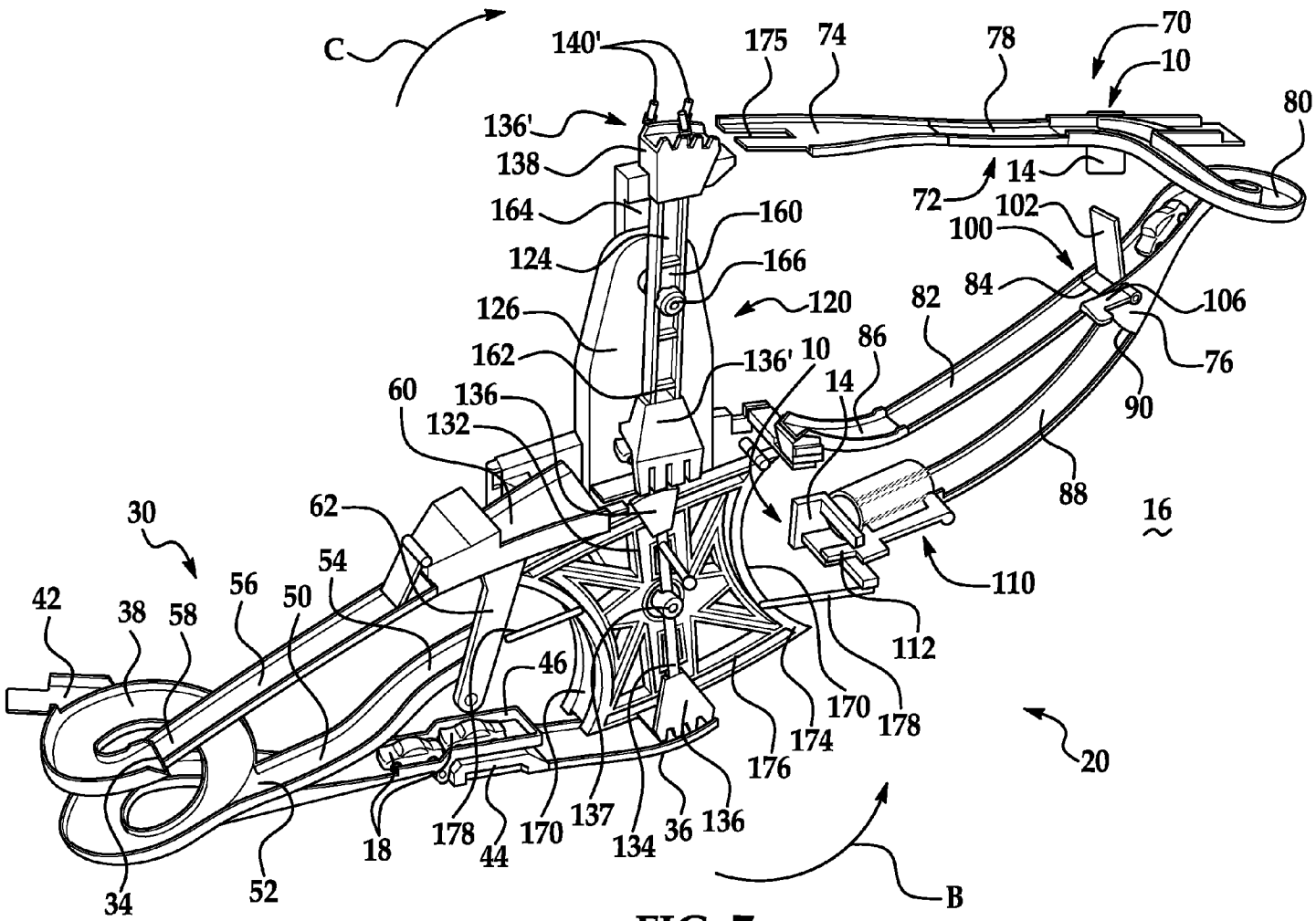
FIG. 7 is a perspective view of the first arm and the second arm of the toy vehicle track set in a vertically aligned position.

Referring now to FIGS. 3 and 5, each claw member 136, 136' includes a base 138, 138' and a plurality of claw arms 140, 140' pivotally mounted to the base 138, 138' for movement between an open position and a closed position. A generally hollow cylindrical mount 142, 142' connects the base 138, 138' of the claw member 136, 136' to a housing 144, 144' of the arm 130, 160.

In some embodiments, a protrusion 146 extends from the base 138 of the first arm 130. The protrusion 146 is configured to engage or contact the activation device 48 of the toy vehicle feed mechanism 44 mounted to the first track segment 32 as the first arm 130 rotates in the direction of arrow B. Contact of the actuation member 48 with protrusion 146 causes downward movement of actuation member 48 in the direction of arrow 49, which in turn causes gate 46 to move in the direction of arrow A and thus release a toy vehicle 18 therefrom. Accordingly, the rotational movement of first arm 130 in the direction of arrow B provides an automatic or sequential release of toy vehicles 18 from vehicle feed mechanism 44 as protrusion 146 actuation member 48 each time the first arm 130 rotates completely about its shaft 137.

In some non-limiting embodiments, a slidable member 148, 148' is movably mounted in the cylindrical mount 142, 142' such that translational or linear movement of the slidable member 148, 148' with respect to arm 130, 160 is possible. The movement of the slidable member 148, 148' facilitates the capture and release of the toy vehicles 18 by the claw members 136 and 136'. The slidable movement of member 148, 148' with respect to arm 130, 160 causes the claw members 136 and 136' to move between open (e.g., toy vehicle 18 release or receive) and closed positions (e.g., toy vehicle 18 capture or holding during rotational movement of arm 130, 160).

A cam surface 150, 150' located on the shaft 137, 166 that supports the arm 130, 160 causes or facilitates the movement of slidable member 148, 148'. As the arm 130, 160 rotates about the shaft 137, 160, a distal end 147, 147' of the slidable member 148, 148' makes intermittent contact with the cam surface 150, 150' due to its cam profile. The intermittent contact causes slidable member 148, 148' to move within the cylindrical mount 142, 142'. In some embodiments, a spring member 145, 145' located within cylindrical mount 142, 142' provides a biasing force to slidable member 148, 148'.

A contact member 149, 149' is secured to slidable member 148, 148'. The contact member 149, 149' protrudes through slotted openings of cylindrical mount 142, 142' such that as slidable member 148, 148' moves within cylindrical mount 142, 142' contact member 149, 149' moves within the slotted openings of the cylindrical mount 142, 142'. The contact member 149, 149' is configured to contact at least one of the claw arms 140, 140' such that as the slidable member 148, 148' moves within cylindrical mount 142, 142' the contact member 149, 149' contacts at least one of the claw arms 140, 140'. The contact with the contact member 149, 149' transitions the claw members 136, 136' between the open and closed positions as the end 147, 147' of the slidable member 148, 148' makes contact with cam surface 150, 150'.

In some non-limiting embodiments, the contact member 149, 149' extends from opposite sides of the cylindrical mount 142, 142'. As the contact member 149, 149' moves within the cylindrical mount 142, 142', the claw arms 140, 140' on opposite sides of cylindrical mount 142, 142' are contacted by contact member 149, 149' and are thus moved between the open and closed positions.

As illustrated in the FIGS. the claw arms 140, 140' are pivotally mounted to the base 138, 138' and extend above and below the base 138, 138' of the claw member 136, 136' so that one end of the claw arms 140, 140' can grasp a toy vehicle while an opposite end can be manipulated by contact member 149, 149' as the slidable member 148, 148' moves within cylindrical mount 142, 142'.

In some non-limiting embodiments, the claw arms 140, 140' are spring biased into the closed position by at least one elastic member or rubber band 151, 151'. In some embodiments, the at least one elastic member or rubber band 151, 151' is coupled to a hook 143, 143' on the cylindrical mount 142, 142' at one end and coupled to a portion of the claw arms 140, 140' at the other end.

As the arms 130, 160 rotate about their respective shafts 137, the cam surface 150, 150' intermittingly applies a force to the distal end 147, 147' of the slidable member 148, 148'. This force overcomes the biasing force of the spring 145, 145' and causes the contact member 149, 149' to move the claw members 140, 140' from their closed position to their open position by overcoming the biasing force of the elastic member 151, 151'. This action is facilitated by the pivotal movement or securement of the claw members 140, 140' to the base member 138, 138'. The movement of the slidable member 148, 148' by the cam surface 150, 150' compresses spring 145, 145' and force the claw members 140, 140' into the open position. When the distal end 147, 147' of the slidable member 148, 148' loses contact with the cam surface 150, 150', the slidable member 148, 148' is moved back towards the cam surface 150, 150' or the shaft 137, 166 due to the biasing force of compresses spring 145, 145', and the contact member 149, 149' no longer maintains the claw members 140, 140' in the open position. Under these conditions, the elastic member 151, 151' rotates the claw arm 140, 140' to its closed position.

As the arm 130, 160 rotates further about the cam surface 150, 150' the cam force is removed, and the biasing spring biases the claw arms 140 back to a closed position. In some non-limiting embodiments, the claw arms 140 of claw member 136' connected to the second arm 160 may have a higher spring-loaded grip than the claw arms 140 of claw member 136 of the first arm 130 (via a higher constant associated with the respective elastic members 151, 151'). The higher spring-loaded grip may allow the claw arms 140' of the second arm 160 to grab or snatch a toy vehicle 18 from the claw arms 140 of the first arm 130 when the claw member 136 of the first arm 130 is aligned or adjacent with the claw member 136' of the second arm 160.

Still further cam 150, 150' can be configured such that the claw arms 140 and 140' of claw members 136 and 136' are positioned into respective open positions when they are aligned with each other such that a toy vehicle 18 can be transferred from claw member 136 to claw member 136'.

As the first arm or first arm member 130 rotates about its axis a toy vehicle 18 is captured by claw member 136. Once captured, the first arm member 130 continues to rotate in the direction of arrow B until the toy vehicle 18 is inverted (e.g., 180 degrees of rotation of the first arm member 130). At this point, the claw member 136' of the second arm or second arm member 160 is adjacent to the claw member 136 of the first arm member 130 such that the inverted toy vehicle 18 can be transferred therebetween. At this point, the second arm member 160 rotates in an opposite direction (illustrated by arrow C) for approximately 180 degrees of rotation such that the inverted toy vehicle 18 is now upright (inverted once again) and ready to be released onto the first end 74 of the fourth track segment 72. Accordingly, the toy vehicle 18 is captured, inverted (via the rotation of the first arm member 130 in a first direction), transferred (between claw member 136 and claw member 136'), inverted once again (via rotation of the second arm member 160 in a second direction opposite to the first direction), and released onto an upper track portion.

Although the first arm member 130 and the second arm member 160 are illustrated as rotating in opposite directions it is, of course, understood that various embodiments of the present invention contemplates that the rotational directions of the first arm member 130 and a second arm member 160 may be the same direction or alternatively completely opposite to those illustrated in the attached drawings.

A seventh track segment 170 is mounted between the first end 132 and the second end 134 of the first arm 130 via a base 176 secured thereto. Accordingly, base 176 and the seventh track segment 170 is rotationally or pivotally mounted to support 120 such that seventh track segment 170 rotates as the first arm 130 rotates.

The seventh track segment 170 is generally arced or has a concave shape to retain a toy vehicle 18 while the first arm rotates 130. As the first arm 130 rotates about its shaft 137, a second end 174 of the seventh track segment 170 is momentarily positioned adjacent the second end 92 of the sixth track segment 88. Further rotation of the first arm 130 temporarily positions the first end 172 of the seventh track segment 170 next to the second end 54 of the second track segment 50, such that the seventh track segment 170 provides a path between the sixth track segment 88 of the upper track portion 70 and the second track segment 50 of the lower track portion 30 of the track set 20.

In some embodiments, a lever 178 extends outwardly from the seventh track segment 170, or alternatively base 176 or first arm member 130, and is configured to engage the activation device 112 of the toy vehicle feed system 110 mounted to the sixth track segment 88. As the first arm 130 rotates, lever 178 contacts an end of the arm member of the activation device 112. The arm member may be pivotally mounted to the sixth track segment 88 and may cause the gate member 115 to move upwardly in the direction of arrow D, for example, from a blocking position to an unblocking position (similar to feed system 44). The movement to the unblocked position releases the toy vehicles 18 from the sixth track segment 88 onto the seventh track segment 170.

In some embodiments, a pair of track segments 170 are secured to base 176 in a facing spaced arrangement such that a track segment 170 is located to receive toy vehicles 18 for each one hundred and eighty degrees of rotation of the lower arm member 130. As such, the base 176 is configured to have a pair of levers 178 configured and positioned to engage actuation device 112 as the base 176 and lower arm 130 rotates about axis 137.

When power is applied to the driving mechanism 128, the first arm 130, and the second arm 160 rotate about their respective shafts 137, 166. A toy vehicle 18 released from the start platform 42 travels, as a result of gravity, along a portion of the first track segment 32 until reaching the toy vehicle feed system 44. As the claw member 136 mounted to the first end 132 of the first arm 130 approaches the second end 36 of the first track segment 32, the protrusion 146 engages the activation device 48, thereby releasing the toy vehicle 18 from the feed system 44.

The released toy vehicle 18 from the feed system 44 reaches the second end 36 of the first track segment 32 at approximately the same time as the claw member 136 mounted to the first end 132 of the first arm member 130. As the first end 132 of the first arm 130 rotates towards the second end 36 of the first track segment 32, the cam surface 150 of the shaft 137 causes the claw arms 140 of the claw member 136 to pivot open to receive the toy vehicle 18. As the first end 132 of the first arm 130 rotates away from the first track segment 32, the cam surface 150 force is minimized and the claw arms 140 are biased back to a closed position to grab the toy vehicle 18 and carry it upwardly and away from the first track segment 32 in the direction of arrow B.

As the first arm 130 and the second arm 160 continue to rotate in their respective directions they rotate or move to a position where the claw member 136 mounted to the first end 132 of the first arm 130 and the claw member 136' mounted to the first end 162 of the second arm 160 are adjacent one another. The cam surfaces 150, 150' of both shafts 137, 166 once again cause the claw arms 140, 140' of both claw members 136, 136' to pivot open to allow transference of the toy vehicle 18 from the claw member 136 of the first arm 130 to the claw member 136' of the second arm 160.

In some embodiments, the cam surface 150' is configured such that the claw arms 140' of the claw member 136' mounted to the second arm 160 are configured to pivot closed when in or slightly after being in meshing engagement (adjacent to) with the claw arms 140 of the claw member 136 of the first arm 130, thereby allowing the claw member 136' of the second arm 160 to grab the toy vehicle 18 from the claw member 136 of the first arm 130. In other words, when the claw member 136 of the first arm 130 is adjacent to the claw member 136' of the second arm 160 the cam surface 150' is configured to first open and then close claw arms 140' of the claw member 136'. While the claw arms 140' of the claw member 136' open and close, the cam surface 150 is configured to maintain the claw arms 140 of the claw member 136 in the open position when the claw member 136' is adjacent to the claw member 136 such that toy vehicle 18 transference can occur as the arms 130 and 160 rotate in their respective directions, which in one embodiment is opposite to each other.

After vehicle transference, further rotation of the second arm 160 positions the claw member 136' containing the toy vehicle 18 adjacent the first end 74 of the fourth track segment 72. When adjacent the fourth track segment 72, the claw arms 140' of the claw member 136' are in an open position (contact of member 148' with cam surface 150') such that the toy vehicle 18 moves from the claw member 136' onto the fourth track segment 72.

Alternatively or in conjunction with the opening of claw arms 140' a tongue member 175 is located at the first end 74 of the fourth track segment 72 such that as the claw member 136' rotates in the direction of arrow C the tongue member 175 is configured and positioned such that it slides under the toy vehicle 18 and dislodge it from base member 138' and claw arms 140' as well as providing a path for the toy vehicle 18 to travel on to as the claw member 136' rotates in the direction of arrow C and away from the first end 74 of the fourth track segment 72.

Once released from the claw member 136' onto the first end 74 of the fourth track segment 72 the toy vehicle 18 travels downwardly along the fourth track segment 72. If the gate 100 is in a closed position, the toy vehicle 18 travels to the fifth track segment 82. The fifth track segment 82 is positioned at a downward angle such the toy vehicle 18 traverses the gap between the upper track portion 70 and the lower track portion 30, specifically from the fifth track segment 82 to the third track segment 56 by jumping across the gap.

Upon successful traversal of the gap between the fifth track segment 82 and the third track segment 56 the toy vehicle 18 then travels from the third track segment 56 back to the adjacent first track segment 32, where it stops at the toy vehicle feed system 44, when the gate 46 is in the blocking position.

Figure 8:
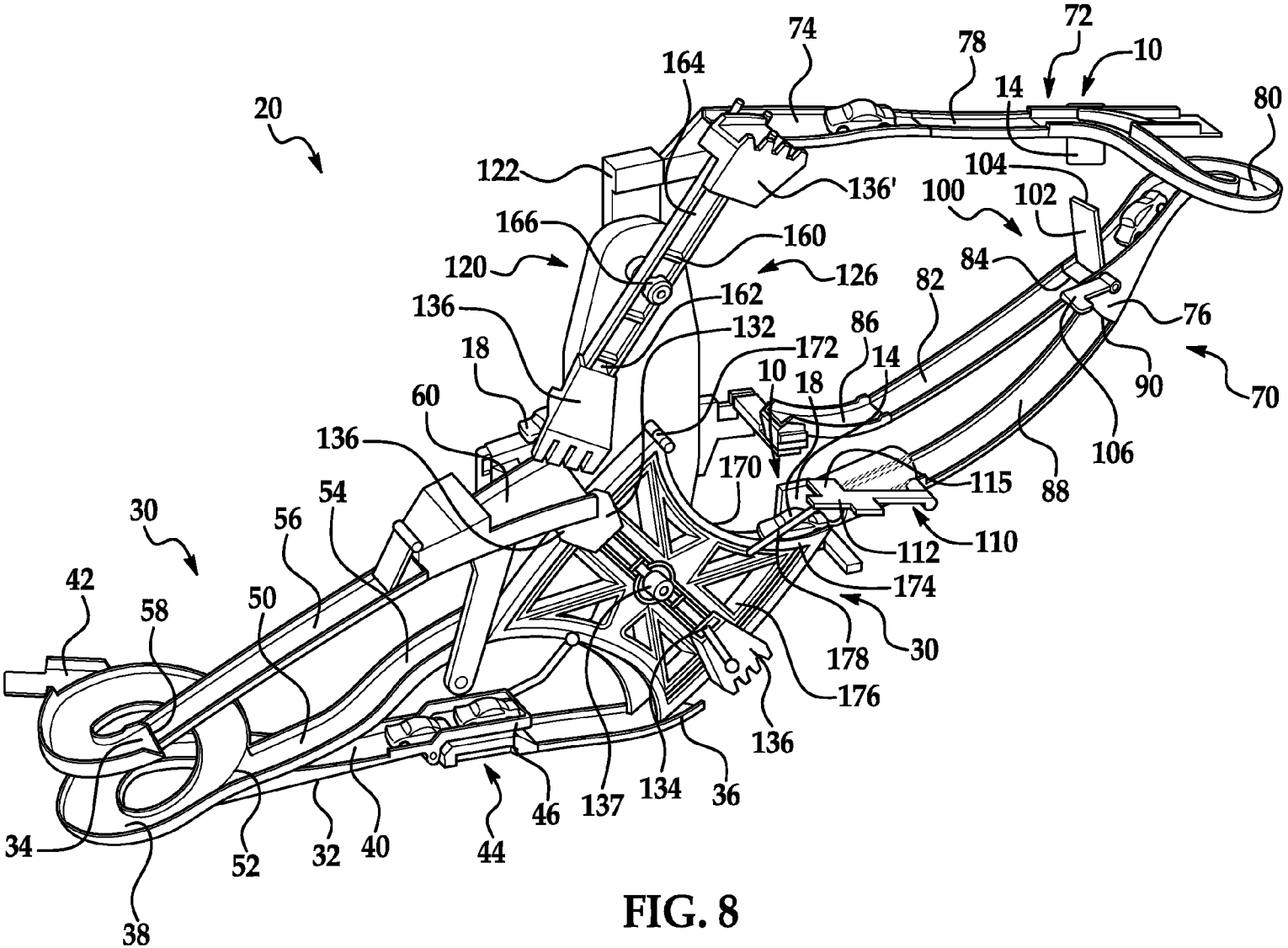
FIG. 8 is a perspective view of the first arm as it actuates a toy feed mechanism of the toy vehicle track set.

When the gate 100 is in the open position, the toy vehicle 18 instead travels down the sixth track segment 88 where it is stopped by the gate 115 of the toy vehicle feed system 110. As the first arm 130 rotates about its shaft 137, the lever 178 protruding from the seventh track segment 170 engages the activation device 112 of the toy vehicle feed system 110 (as illustrated in FIG. 8) such that the toy vehicle 18 is released from the feed system 110. The toy vehicle 18 is then received on the seventh track segment 170 which has been rotated into a receiving position as the first arm 130 rotates about shaft 137. Rotation of the first arm 130 causes the toy vehicle 18 to move from the second end 174 to the first end 172 of the seventh track segment 170. When the first end 172 of the seventh track segment 170 is adjacent the second end 54 of the second track segment 50, gravity causes the toy vehicle 18 to move to the second track segment 50. As illustrated, the convex shape of track segment 170 helps facilitate this transference of the toy vehicle 18 as arm 130 rotates in the direction of arrow B.

Once transferred, the toy vehicle 18 travels from the second track segment 50 back to the first track segment 32 where it is stopped once again by the toy vehicle feed system 44.

Accordingly, a toy track set 20 having a central motorized spine for rotating two arms (130, 160) is provided. Each arm has gripper claws 140, 140' on one end. The gripper claws 140, 140' are configured for movement between an open and closed position via a cam surface 150, 150' that works in conjunction with the rotating arms 130, 160 in order to grip and release toy vehicles 18 in order to raise them from the bottom of the toy track set 20 to the top of the toy track set 20. Alternatively, the rotating arms 130, 160 are configured to vertically raise the toy vehicles 18 from a lower position to a higher position such that gravity can them be used to have them traverse back down to the lower position for subsequent vertical movement.

In an alternative embodiment, the rotating arms 130, 160 may be configured to grip and release toy vehicles 18 in order to lower them from the top or elevated position of the toy track set 20 to a bottom or lower position of the toy track set 20.

In various embodiments, the toy vehicles 18 can traverse downwardly (e.g., gravity driven) through at least three possible user-determined paths. For example, one path directs the toy vehicles around a U-turn, then jumping across a gap directly through the path of the rotating arms, which regularly or intermittently block the jump path or gap and provide an element of peril.

A user operated gate on one of the track segment allows the user to select another path that directs the toy vehicles around the same U-turn, then directs them down to a lower track having an automatic stop gate, which is lifted and dropped regularly in sync with one of the rotating arms.

This gate when lifted by movement of the rotating arm allows a retained toy vehicle to be released onto one of two arced segments that rotate along with rotating arm. As such, the vehicles released by the rotating arm get a motorized ride across a gap and then deposited on the other side. There are two possible paths from the gap, one via the aforementioned vehicle jump and the other via the aforementioned rotating arced track segment. Both of these paths lead into another U-turn, which feeds the toy vehicles a feeder lane that directs the toy vehicles towards one of the claw members of one of the rotating arms for pickup. This feeder lane also has an automated or automatic gate that is lifted as one of the rotating arms rotates about it axis. Similar to the other gate actuation of the same allows a toy vehicle to traverse into the appropriately positioned claw member as the arm rotates about its axis.

Another or third path simply lets the cars exit the track set at the top to enter another track set adjacent to this track set.

A lower arm of the two rotating arms is configured to reliably grab the way vehicle off the feeder track segment, and then rotate it approximately one hundred and eighty degrees to vertically raise the toy vehicle and hand it off to an upper rotating arm. The upper rotating arm is configured to reliably grab the toy vehicle, which is now inverted due to it being rotated one hundred and eighty degrees. At this point, wherein the claw members of the upper and lower arms are now adjacent to each other the claw member of the lower arm will release the toy vehicle into the claw member of the upper arm, which then rotates it approximately one hundred and eighty degrees so it is still further upward. At this point the claw member will release the captured toy vehicle onto an upper track segment. Also by virtue of rotating another one hundred and eighty degrees the toy vehicle is now operate and ready to roll onto the upper track segment.

In one non-limiting embodiment each claw member has a plurality or three finger grippers or claw arms rotatably or pivotally mounted thereto. Still further and in one non-limiting embodiment, the claw arms are positioned or staggered with respect to each other such that the claw arms of the upper and lower claw members interleave or mesh with each other when they are adjacent to each other and the toy vehicle is being transferred therebetween. In one embodiment, the grippers or claw arms have rubber fingertips for grip, and they are spring-loaded in the closed position so they snap shut to grab the car when the cam member dictates.

In one non-limiting embodiment, the upper grippers or claw arms of the upper claw member have a higher spring-loaded grip, so that they will pull the car away from the lower grippers if there is overlap on a narrow toy vehicle being transferred therebetween.

In one embodiment, the track section feeding the toy vehicles into the rotating track segment is fully automatic in that the stop gate of the associated feeder mechanism automatically opens and closes to allow a waiting toy vehicle to ride the rotating track across the gap. In order to ensure that the toy vehicle traverses the gap the opening and closing of the gate is operated by the lower rotating arm which is connected to the rotating track segment and thus can be configured for proper synchronization.

The toy vehicle feeder mechanism for the claw member of their lower rotating arm is also configured to be actuated or synchronized with the rotating arm member such that the feeder mechanism or feed system is configured to allow a plurality of toy vehicles to be queued up and dispense exactly one toy vehicle at the right time to be picked up by the lower rotating claw member, and not let other waiting toy vehicles to get mixed or lost from the track set when multiple toy vehicles are queued up in other ones are entering the rear of the queue after recirculating through the toy track set.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A toy vehicle track set comprising:

a first track portion;

a second track portion distal from the first track portion, the first track portion and second track portion defining a gap therebetween; and a pair of separately rotating arms that cooperate to transfer a toy vehicle from one of said pair of arms to another one of said pair of arms and across the gap from the first track portion to the second track portion such that when released at the second track portion, the toy vehicle may traverse along a path of the track set from the second track portion to the first track portion.

2. The toy vehicle track set according to claim 1, wherein the track set is mounted to a wall and the toy vehicle may traverse along the path due to gravitational forces acting on the toy vehicle.

3. The toy vehicle track set according to claim 1, wherein the track set is positioned on a horizontal surface or any combination of vertical and horizontal surfaces.

4. The toy vehicle track set according to claim 1, wherein each of the pair of separately rotating arms includes at least one claw member having a plurality of claw arms, the claw member being movable between an open position and a closed position for releasably grasping the toy vehicle.

5. The toy vehicle track set according to claim 4, wherein the pair of separately rotating arms are configured to transfer a toy vehicle from a first position on the first track portion to a second position on the second track portion.

6. The toy vehicle track set according to claim 5, wherein the claw members mounted to pair of separately rotating arms are configured to transfer a toy vehicle from one of the pair of rotating arms to another of the pair of rotating arms.

7. The toy vehicle track set according to claim 4, wherein movement of the claw members from the closed position to the open position is facilitated by contact with a cam surface of a shaft upon which each rotating arm is configured to rotate.

8. The toy vehicle track set according to claim 7, wherein the cam surface intermittently moves each claw member between the open position and the closed position as the pair of rotating arms rotate.

9. The toy vehicle track set according to claim 8, wherein the claw members connected to a first arm of the pair of rotating arms include a first grip mechanism having a first spring load force and the claw members mounted to a second arm of the pair of rotating arms include a second grip mechanism having a second spring load force, wherein the second spring load force is greater than the first spring load force.

10. The toy vehicle track set according to claim 1, wherein each one of the pair of rotating arms is rotatably secured to a central motorized spine.

11. The toy vehicle track set according to claim 1, wherein the path of the track set includes a plurality of user-determined alternative paths.

12. The toy vehicle track set according to claim 11, wherein one of the alternative paths directs toy vehicles around a curved portion, then across the gap between the second track portion and the first track portion directly through the path of the pair of rotating arms, which intermittently block the gap as they rotate and provide an element of peril as the arms rotate.

13. The toy vehicle track set according to claim 11, wherein one of the alternative paths directs toy vehicles around a curved portion and then down to a lower track and toy vehicle feed system, which is synchronized with the pair of rotating arms.

14. The toy vehicle track set according to claim 13, wherein the synchronized toy vehicle feed system allows toy vehicles to enter an arced segment of track that rotates with at least one of the arms.

15. The toy vehicle track set according to claim 11, wherein the plurality of user-determined alternative paths lead into a curved portion, which feeds the toy vehicles into a straight portion of track directing the toy vehicles towards the claw members for pickup.

16. The toy vehicle track set according to claim 1, wherein the toy vehicle track set includes a third path configured to couple to other toy vehicle tracks sets.

17. A toy vehicle track set comprising:

a first track portion;

a second track portion elevated vertically from the first track portion;

a pair of arm members rotatably mounted to a support, wherein each arm member has a claw member configured to releasably receive and retain a toy vehicle therein, wherein the pair of arm members and each claw member associated therewith are configured to transfer a toy vehicle from one of said pair of arm members to another one of said pair of arm members as the pair of arm members each rotate about an axis.

18. The toy vehicle track set as in claim 17, wherein the toy vehicle is moved vertically from a first position to a second position as it is being transferred between the pair of arm members.

19. A toy vehicle track set comprising:

a lower track portion;

a first toy vehicle feed mechanism configured to release a toy vehicle from the lower track portion upon actuation of an actuator of the first toy vehicle feed mechanism;

an upper track portion having an upper end and a first lower end;

a second toy vehicle feed mechanism configured to release a toy vehicle from the upper track portion upon actuation of an actuator of the second toy vehicle feed mechanism;

a first arm member rotatably secured to the toy vehicle track set, the first arm member having a claw member configured to move from an open position to a closed position in order to receive the toy vehicle from the first toy vehicle feed mechanism;

a second arm member rotatably secured to the toy vehicle track set, the second arm member having a claw member configured to move from an open position to a closed position in order to receive the toy vehicle from the claw member of the first arm member, wherein the second arm member transfers the toy vehicle to the upper end of the upper track portion after it has received the toy vehicle from the claw member of the first arm member; and wherein the actuator of the first toy vehicle feed mechanism is actuated through rotational movement of the first arm member.

20. The toy vehicle track set as in claim 19, wherein the actuator of the second toy vehicle feed mechanism is actuated through rotational movement of the first arm member and the first arm member further comprises a concave shaped track segment configured to receive a toy vehicle from the second toy vehicle feed mechanism and transfer the toy vehicle across a gap of the toy vehicle track set as the first arm member rotates about its axis.

* * * * *